US009181850B2

(12) United States Patent
Roby

(10) Patent No.: US 9,181,850 B2
(45) Date of Patent: Nov. 10, 2015

(54) HYBRID FAN DRIVE WITH CVT AND ELECTRIC MOTOR

(75) Inventor: Joshua L. Roby, Battle Creek, MI (US)

(73) Assignee: BorgWarner Inc., Auburn Hills, MI (US)

( * ) Notice: Subject to any disclaimer, the term of this patent is extended or adjusted under 35 U.S.C. 154(b) by 846 days.

(21) Appl. No.: 13/500,946

(22) PCT Filed: Oct. 15, 2010

(86) PCT No.: PCT/US2010/052814

§ 371 (c)(1), (2), (4) Date: Aug. 24, 2012

(87) PCT Pub. No.: WO2011/047243

PCT Pub. Date: Apr. 21, 2011

(65) Prior Publication Data

US 2012/0328454 A1 Dec. 27, 2012

Related U.S. Application Data

(60) Provisional application No. 61/252,666, filed on Oct. 17, 2009.

(51) Int. Cl.

| | |
|---|---|
| ***F16H 55/56*** | (2006.01) |
| ***F16H 59/00*** | (2006.01) |
| ***F16H 61/00*** | (2006.01) |
| ***F16H 63/00*** | (2006.01) |
| ***F16H 9/12*** | (2006.01) |
| ***F01P 7/02*** | (2006.01) |
| ***F01P 7/10*** | (2006.01) |
| ***F01P 7/04*** | (2006.01) |

(52) U.S. Cl.
CPC *F01P 7/046* (2013.01); *F01P 7/048* (2013.01)

(58) Field of Classification Search
CPC ..... F16H 55/56; F16H 63/062; F16H 63/067; F16H 55/563; F01P 7/042
USPC ..... 474/8, 14, 39; 123/41.12, 41.48
See application file for complete search history.

(56) References Cited

U.S. PATENT DOCUMENTS

| | | | | |
|---|---|---|---|---|
| 2,995,295 | A * | 8/1961 | Day | 416/133 |
| 3,813,881 | A * | 6/1974 | Neelen | 60/521 |
| 5,049,112 | A * | 9/1991 | Gunsing | 474/8 |
| 5,207,167 | A * | 5/1993 | Inomata | 112/280 |
| 5,584,371 | A * | 12/1996 | Kelledes et al. | 192/58.61 |
| 6,406,390 | B1 * | 6/2002 | Roby | 474/14 |
| 6,689,000 | B1 * | 2/2004 | Kapaan et al. | 474/20 |
| 6,962,543 | B2 * | 11/2005 | Roby | 474/39 |
| 7,059,279 | B2 * | 6/2006 | Bystedt et al. | 123/41.31 |
| 7,217,204 | B2 * | 5/2007 | Roby | 474/14 |
| 7,243,564 | B2 * | 7/2007 | Chonan et al. | 74/329 |
| 7,427,248 | B2 * | 9/2008 | Chonan | 474/93 |
| 7,520,351 | B2 * | 4/2009 | Uchisasai et al. | 180/65.245 |
| 8,714,116 | B2 * | 5/2014 | Hartman et al. | 123/41.49 |
| 2001/0025610 | A1 * | 10/2001 | Weber | 123/41.12 |

(Continued)

*Primary Examiner* — Henry Liu

(57) ABSTRACT

A hybrid accessory drive system having two operational modes, a mechanical mode and an electric mode. The accessory is typically a cooling fan. A continuously variable mechanical belt drive mechanism drives the accessory as one mode of operation. An electric motor along with a planetary roller screw mechanism which converts rotary motion to axial motion is used to change the sheave position and thus the drive ratio. Upon disengagement of the mechanical drive mode, the electric motor can be used to drive the accessory in a second mode.

20 Claims, 9 Drawing Sheets

(56) References Cited

U.S. PATENT DOCUMENTS

| | | | | |
|---|---|---|---|---|
| 2002/0096133 | A1* | 7/2002 | McGovern et al. | 123/41.48 |
| 2002/0155909 | A1* | 10/2002 | Roby | 474/14 |
| 2003/0041814 | A1* | 3/2003 | Laird et al. | 123/41.12 |
| 2005/0037876 | A1* | 2/2005 | Unno et al. | 474/12 |
| 2005/0121245 | A1* | 6/2005 | Tsukada et al. | 180/230 |
| 2005/0124461 | A1* | 6/2005 | Inoue et al. | 477/179 |
| 2005/0233843 | A1* | 10/2005 | Yamane et al. | 474/28 |
| 2006/0019781 | A1* | 1/2006 | Roby | 474/8 |
| 2006/0030454 | A1* | 2/2006 | Uchisasai et al. | 477/77 |
| 2006/0270503 | A1* | 11/2006 | Suzuki et al. | 474/144 |
| 2007/0197321 | A1* | 8/2007 | Ishioka et al. | 474/28 |
| 2008/0153636 | A1* | 6/2008 | Inoue et al. | 474/28 |
| 2009/0017958 | A1* | 1/2009 | Kurihara | 475/210 |
| 2011/0092324 | A1* | 4/2011 | Roby | 474/8 |
| 2011/0177903 | A1* | 7/2011 | Campbell | 475/149 |
| 2012/0288377 | A1* | 11/2012 | Hartman et al. | 417/13 |

* cited by examiner

HYBRID FAN DRIVE WITH CVT AND ELECTRIC MOTOR

TECHNICAL FIELD

The present invention relates to hybrid fan drive utilizing a continuously variable transmission, the fan drive having two operational modes, a mechanical mode and an electric drive mode.

BACKGROUND

As government mandated fuel economy and emissions regulations continue to tighten, more pressure is being applied to vehicle manufacturers to find new technologies that will increase fuel economy and minimize emissions from internal combustion engines. At the forefront of the new emissions and fuel economy technology is the electrification of the vehicle powertrain. Electrification enables sophisticated control options for powertrain components that are traditionally directly coupled to engine speed. Additionally, some hybrid systems have been proposed which introduce new fuel conservation techniques, such as start-stop technology.

Vehicles typically include a cooling system to dissipate heat developed by the vehicle power plant, such as an internal combustion engine. In a typical vehicle, the cooling system moves coolant through the engine. The coolant flowing through the engine absorbs heat and transfers it away from the engine. However, heat from the coolant must ultimately be dissipated to the air by passing air through the radiator. If the vehicle is moving with significant velocity, the ram air forced through the radiator is often sufficient to cool the radiator. However, when the vehicle is moving at low velocity, a fan is required to move air through the radiator.

These cooling fans are driven in a number of different ways. A wide range of systems are available to transmit power from the engines to the rotating cooling fans. Some of these include on/off clutches and viscous fan drives. With these devices or systems, a continuous belt is utilized to transfer rotating energy from the vehicle engine to the cooling fan of the fan drive systems.

There is a need for improved fan drive systems that assist in the vehicle and engine thermal management. There is also a need for thermal systems which can improve fuel economy and reduce undesirable vehicle emissions.

SUMMARY OF THE INVENTION

The present invention provides a continuously variable belt pulley transfer system that has two modes of operation and has particular use for operating an engine cooling fan. The system is comprised of a two-pulley assembly with a continuous belt transferring rotary motion between them. The pulleys are each formed by forward and rear sheaves that define opposed conical surfaces. The drive ratio between the pulleys is determined by the position of the V-shaped belt between the conical surfaces of the sheaves.

The present invention includes a continuously variable system which has two operation modes, a mechanical mode and an electrical mode. One mode provides a direct variable speed mechanical drive. The second mode provides direct electric drive to the fan.

The invention includes a rubber belt CVT fan drive with fly weight belt tensioning mechanism on the input side and direct acting electronic sheave control mechanism on the output mechanism. A roller screw mechanism is used to control the position of the rear sheave on the output member. An electric motor, such as a brushless DC (BLDC) motor, is used to electronically control the actuation of the roller screw mechanism.

The present invention can manage the thermal systems in the vehicle and engine, and at the same time can improve fuel economy and reduce undesirable vehicle emissions.

Further objects, features and benefits of the invention will become apparent to persons skilled in the art from the following description of the preferred embodiments when viewed in accordance with the attached drawings and appended claims.

DESCRIPTION OF THE PREFERRED EMBODIMENTS

Figure 1:
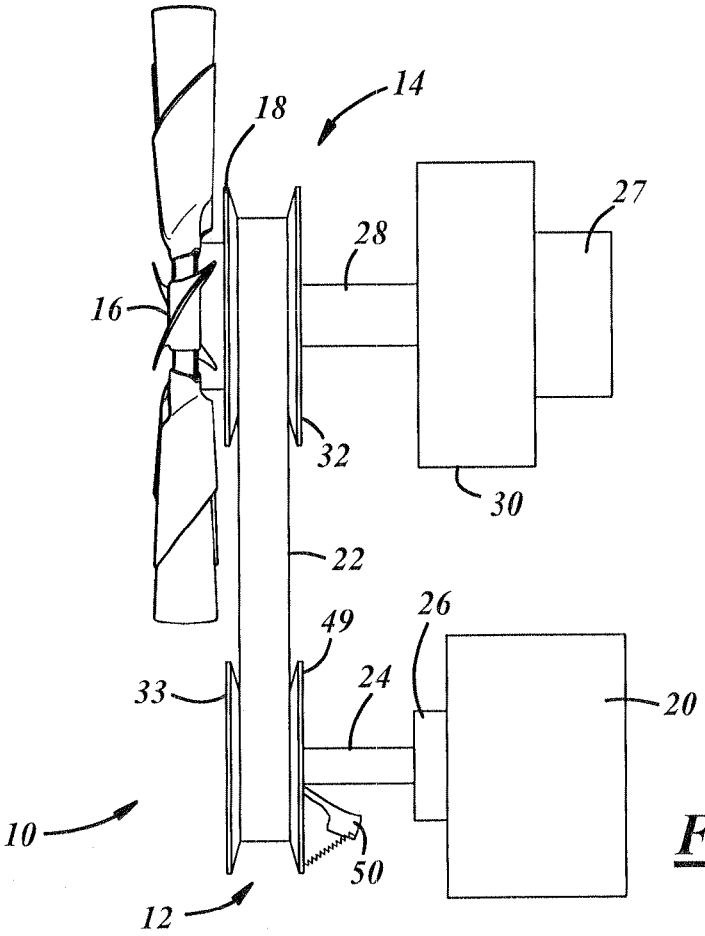
FIG. 1 is a schematic diagram of a CVT system in accordance with an embodiment of the present invention.

For the purpose of promoting and understanding the principles of the present invention, reference will now be made to the embodiments illustrated in the drawings and specific language will be used to describe them. It will nevertheless be understood that no limitation as to the scope of the invention is hereby intended. The invention includes any alternatives and other modifications in the illustrated devices and described methods and further applications of the principles of the invention which would normally occur to persons or ordinary skill in the art to which the invention relates.

In general, the present invention concerns a continuously variable belt drive system for driving a cooling fan which is a hybrid system having two operational modes. The preferred embodiment has a first mechanical mode comprising a rubber belt continuous variable transmission (CVT) having a ratio control driven by an electric motor, particularly a brushless DC (BLDC) motor. The second mode is a direct electric drive mode in which the output member of the CVT is driven by the same BLDC motor that controls the mechanical drive ratio.

As with most CVT systems, there are two V-shaped members, a driving member and a driven member. A continuous belt having a V-shaped cross section is positioned between the two V-shaped sheaves. The belt is configured to engage facing conical friction surfaces of a pair of opposing pulley sheaves.

The continuous variable feature of the CVT system is accomplished by changing the distance between the sheaves of a particular pulley.

If the sheaves are moved apart on one of the two pulleys, the V-shaped belt moves radially inward to a lower radius of rotation of pivot. If the sheaves are moved closer together, the conical surfaces push the V-shaped belt radially outward so the belt is riding in a larger diameter. CVT systems are sometimes referred to as "infinitely variable transmission" systems since the V-belt can be situated at virtually any infinite range of radii depending upon the distance between the conical pulley sheaves.

With the present invention, a continuously variable belt drive system is preferably used to drive a cooling fan. This allows the speed of the cooling fan to be equated to the amount of cooling required for the engine by adjusting the sheaves so that an appropriate belt ratio is established.

A hybrid fan drive system in accordance with a preferred embodiment of the present invention is shown schematically in FIG. 1 and indicated generally by the reference numeral 10. This system includes an input sheave drive assembly 12 and an output sheave drive assembly 14. A cooling fan 16 is connected directly to stationary sheave member 18 on the output sheave assembly and is driven directly by it. The cooling fan 16 is typically situated adjacent a vehicle radiator (not shown).

The input sheave member assembly 12 is connected directly to the engine 20 and drives at engine input speed. A continuous belt 22, preferably a rubber belt, is positioned between the two sets of sheaves 12 and 14. The belt is preferably V-shaped and can be made of a variety of known configurations and materials. The belt is driven by frictional contact with the pulley of the driving member assembly 12. Likewise, the driven member of sheave assembly 14 is propelled by frictional contact with the rotating belt.

The driving member assembly 12 includes a driving shaft 24 that can be configured to be mounted to an engine, such as by mounting member 26. The driven sheave member assembly 14 has a shaft 28 that has an electric motor 30 attached to movable sheave member 32 for changing the ratio relative to the input sheave member. A preferred driven sheave member assembly of this type is shown in more detail in FIG. 2.

Figure 2:
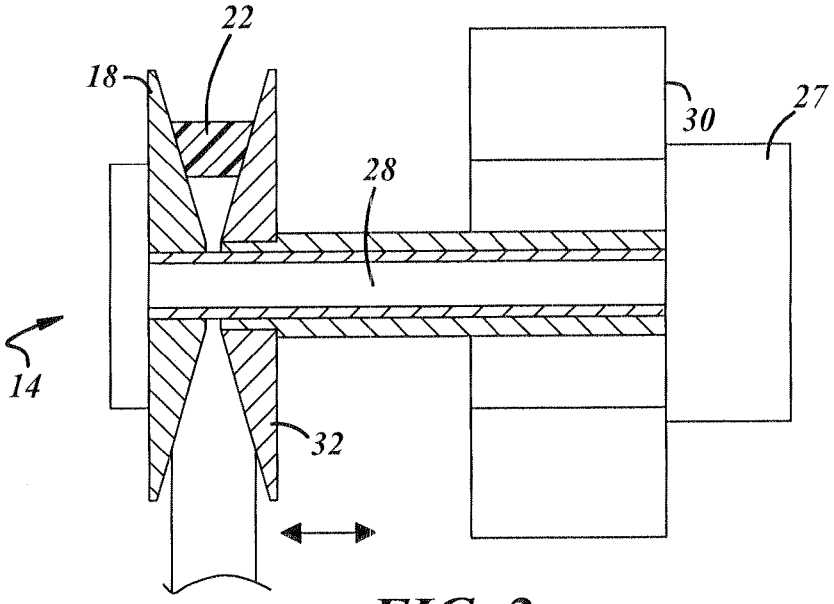
FIG. 2 is an embodiment of output sheaves for a CVT system which can be used with the present invention.

The CVT belt drive system in accordance with the present embodiment of the invention functions differently than typical CVT drive systems. Traditional CVT drive systems use a centripetal fly weight system for ratio control on the input member, and tension the belt with a spring on the output member. Since the present invention requires direct electronic control, these functions are reversed so the electronic actuator is integrated into the output member. FIG. 2 illustrates an output member used to control the fan drive ratio. A motor 30 is used to turn a planetary roller screw mechanism 40 (shown in FIG. 3) which moves the rear sheave 32 axially and changes the drive ratio. As the sheaves on the output member move closer together, the belt is forced to a larger radius on the sheaves. Since the belt has a fixed length and there is a fixed center distance between the input and output members, the belt forces the sheaves apart on the input member and moves to a smaller radius on the input sheaves, effectively reducing the drive ratio.

Figure 4:
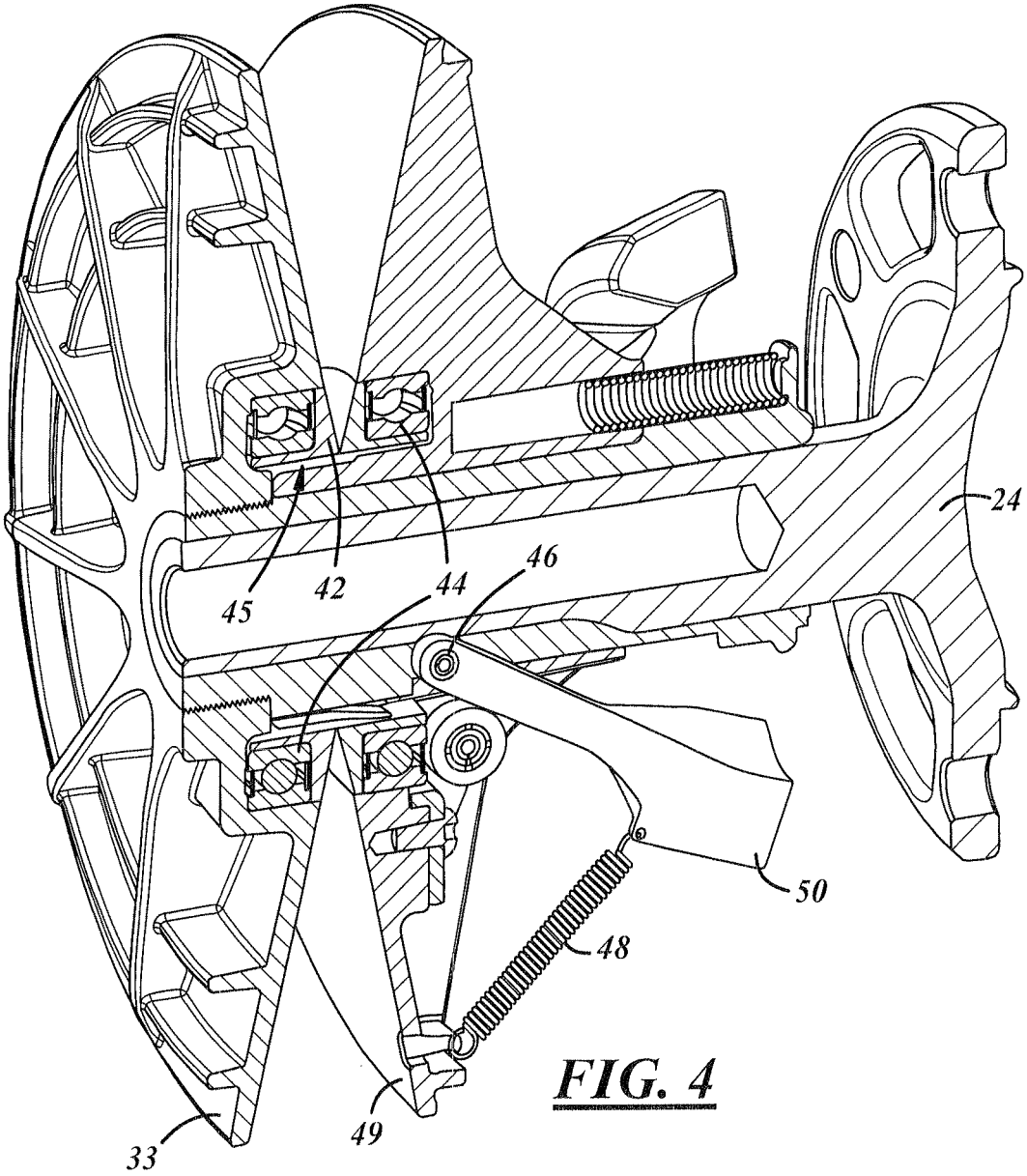
FIG. 4 is an enlarged view of a CVT input member which can be used with an embodiment of the present invention.

A set of free spinning surface members 42 on the sheave faces at the inner diameter creates a disengagement mechanism 45 on the input member. This is shown in FIG. 4. Bearing members 44 allow the surface members 42 to rotate freely. As the drive moves to lower ratios, the belt eventually runs on these free spinning members 42 which disengage the output member. The input mechanism can be disengaged in this manner when it is desired to have the driven sheave mechanism be operated solely by the electric motor.

As indicated, an electric motor 30 is integrated into the output member 14 for controlling the drive ratio. For hybrid operation, a brushless DC (BLDC) motor is preferably used for adjusting the sheave position, although other electric motors, such as a stepper motor could be utilized. A clutching mechanism is integrated to selectively drive either the sheave positioning mechanism, or the rear sheave on the output member directly. Since the device incorporates a disengagement mechanism, the electric motor can drive the sheave to a mechanical disengagement position. At this point, the clutch mechanism disconnects the position actuator in connection to the rear output sheave from the BLDC motor and connects the rear sheave directly to the BLDC motor, enabling the fan to be driven electrically.

The CVT system in accordance with this embodiment, provides a direct variable speed mechanical drive by changing the drive ratio rather than achieving variable speed through a slipping clutch. The present invention does not have "slip heat" and thus does not need heat sink fins or other devices for dissipating the heat. With slipping clutch systems, control logic is typically utilized to prevent the clutch from operating in a zone where it is generating excessive slipping. This often requires the clutch to operate at a speed other than what is ideal for cooling the vehicle.

With the present invention, there is no heat generated other than that of the belt entering or exiting the pulley sheaves. As a result, the device is capable of achieving mechanical drive efficiency of up to 97%. The invention thus provides optimal fan speed as required for vehicle cooling under all operating conditions.

The disengagement mechanism 45 allows the fan to be completely disengaged from the engine. This allows the fan to come to a complete stop rather than continue to rotate at a few hundred rpm, which is the typical disengage speed for most mechanical fan drives. With the present invention, and the capability of mechanically changing the drive ratio and overspeeding the fan, the fan can be sized much smaller and still provide the requisite air flow at low engine speeds. This provides flexibility and sizing of the heat exchanger package and even the vehicle frontal opening, which impacts aerodynamics of the vehicle. Furthermore, the ability to downsize the fan using the CVT mechanism complements the electric drive mode, as a smaller lower torque fan is better suited for direct drive by the electric motor.

Figure 3:
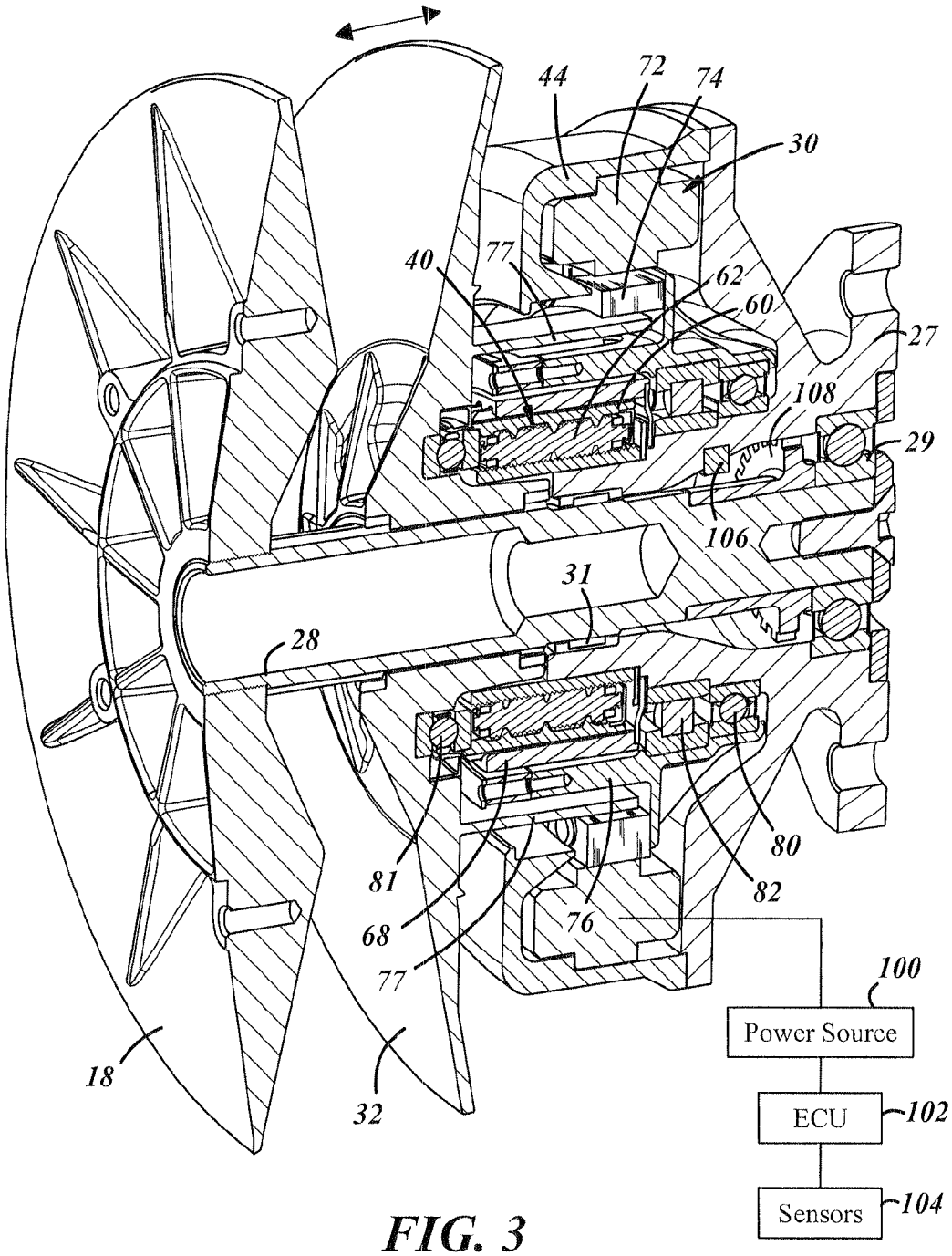
FIG. 3 illustrates a planetary roller screw sheave positioning mechanism.

As shown in FIG. 3, the two sheaves 18 and 32 of the driven member 14 are mounted on a central axle or shaft member 28. The front sheave 18 is fixedly secured to the shaft or axle 28 while the rear sheave 32 is slidingly positioned on the axle member 28. The rear sheave is typically splined to the shaft so it does not rotate relative to the shaft. The axle 28 is rotatably mounted to the mounting housing 27 by ball bearing 29 and needle bearing 31.

FIG. 3 also depicts the preferred planetary roller screw mechanism 40 that is used to control the position of the rear sheave on the output member. This provides a high efficiency method of converting the rotary motion from the motor to a linear motion that controls the CVT drive ratio.

The planetary roller screw mechanism 40 provides rotary to a linear motion transfer with no sliding friction. The planetary roller screw mechanism also does not need to recirculate elements and it has much higher speed and load capacity than a ball screw. In addition, the roller screw actuator cannot be back driven. This means that there is no holding torque and accompanying parasitic electric power draw required to hold the actuator in a given position.

The roller screw mechanism includes a roller screw housing 60 and a plurality of roller members 62. These components are better shown in FIGS. 5 and 6. The roller members rotate and are held in place by spacers 63 and retaining snap rings 61, as better shown in FIG. 7. Preferably six to eight roller members 62 are provided. The roller screw housing 60 has a plurality of teeth or splines 64 around its outer surface. The splines 64 are meshed within corresponding grooves 66 in roller screw sleeve member 68. The roller screw housing 60 moves (translates) in the axial direction relative to the roller screw sleeve member 68. This in turn axially translates the rear sheave 32, and in turn changing the drive ratio and fan speed.

The electric motor 30 is integrated into the driven shaft assembly mounting housing 44. As the rotor assembly turns, the motor drives the planetary screw mechanism through the splined interface. The planetary roller screw members 62 roll inside the roller screw housing 60 and are held in angular position by spacer rings. As housing member 60 rotates, it translates along a threaded sleeve member 84 via the planetary roller screw members.

The sleeve member 84 in the planetary roller screw mechanism 40 has a threaded surface which interacts with annular grooves on the roller members 62. The threads are spiral screw type threads. Since the sleeve member 84 is stationary, the threads act to rotate the roller members 62 and translate them in the axial direction.

The grooves 63 on the roller members 62 also could be spiral-type threads so they would follow the spiral-type threads on the sleeve member 84. Preferably, however, the grooves 63 on the roller members are simply straight circular grooves with corresponding ridges, and not screw-type threads. In order to allow the set of 6-8 roller members to stay in position axially, the grooves 63 are shifted axially on each consecutive roller member in the set. The amount of the groove shifting is determined by the equation: thread pitch/number of roller members. If there is more than one start for the screw-type threads on the sleeve member 84, then the amount of groove shifting is determined by the equation: (thread pitch×number of starts)/number of rollers.

Figure 5:
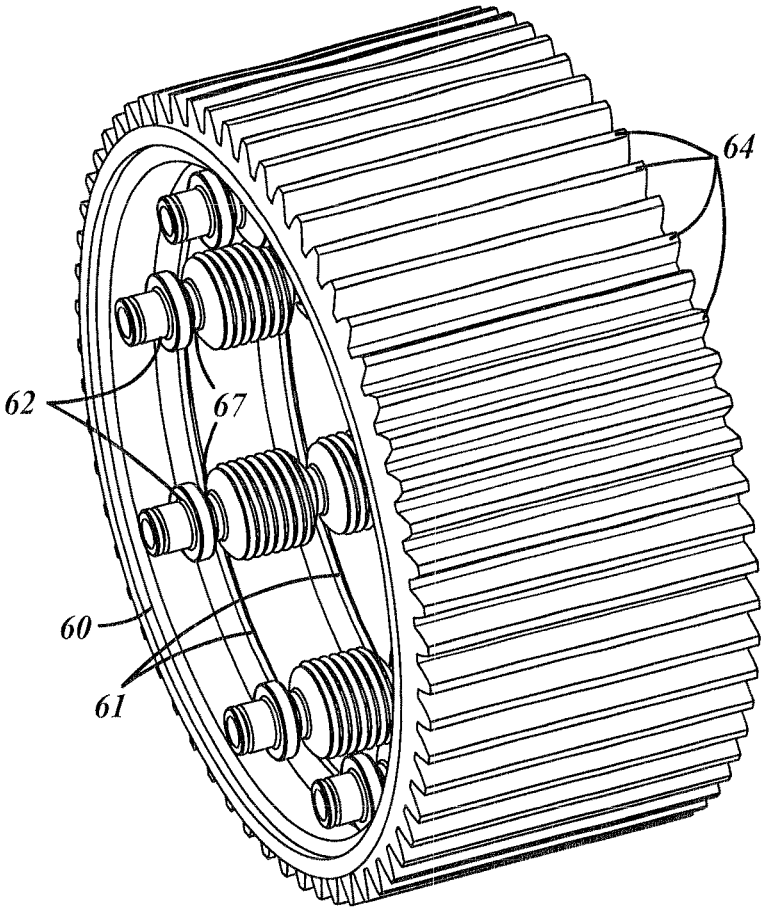
FIGS. 5 and 6 are enlarged views depicting components of a planetary roller screw mechanism which can be used with an embodiment of the present invention.
Figure 6:
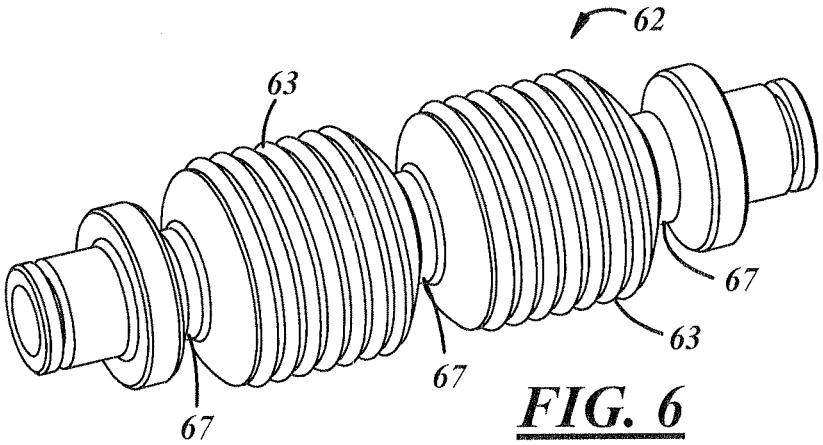

Also, as shown by FIGS. 5 and 6, the sleeve member 60 has a series of circular ridges 61. The ridges mate with the deep grooves 67 on the roller members 62. The mating ridges and deep grooves keep the roller members and sleeve member in axial alignment.

The motor 30 includes a stator 72 and a rotor 74. The rotor is connected to a rotor housing 76. Ball bearing 80 and roller bearing 82 allow the rotor housing 76 to rotate relative to the housing members 44 and 27. When the motor is energized, the rotor housing 76 rotates with the rotor. A set of pawl members 90 are pivotally attached to the rotor housing 76 and biased by spring members 93 in a direction toward the central shaft member 28. The pawl members 90 engage notches 79 in the roller screw sleeve member 68 causing the sleeve member 68 to rotate with the rotor housing 76. This forms a pawl clutch mechanism which transfers the torque from the housing 76 to sleeve member 68. This in turn causes the planetary roller screw mechanism 40 to rotate which in turn causes the roller members 62 to drive the roller screw housing 60 in the axial direction. Axial translation of the roller screw housing 60 in a direction toward the rear sleeve member 32 acts on thrust bearing 81 to force the sheave member 32 toward the front stationary sheave member 18. This forces the V-shaped drive belt member 22 radially outwardly changing the speed of the cooling fan 16.

When it is required to change the speed of the fan in the other direction, the electric motor 30 is reversed, driving the planetary roller screw mechanism to the right. The force of the belt 22 on the rear sheave member 32 forces the sheave member 32 away from the front sheave member 18. This in turn changes the drive ratio from the belt and the speed of the fan accordingly.

Figures 8, 9:
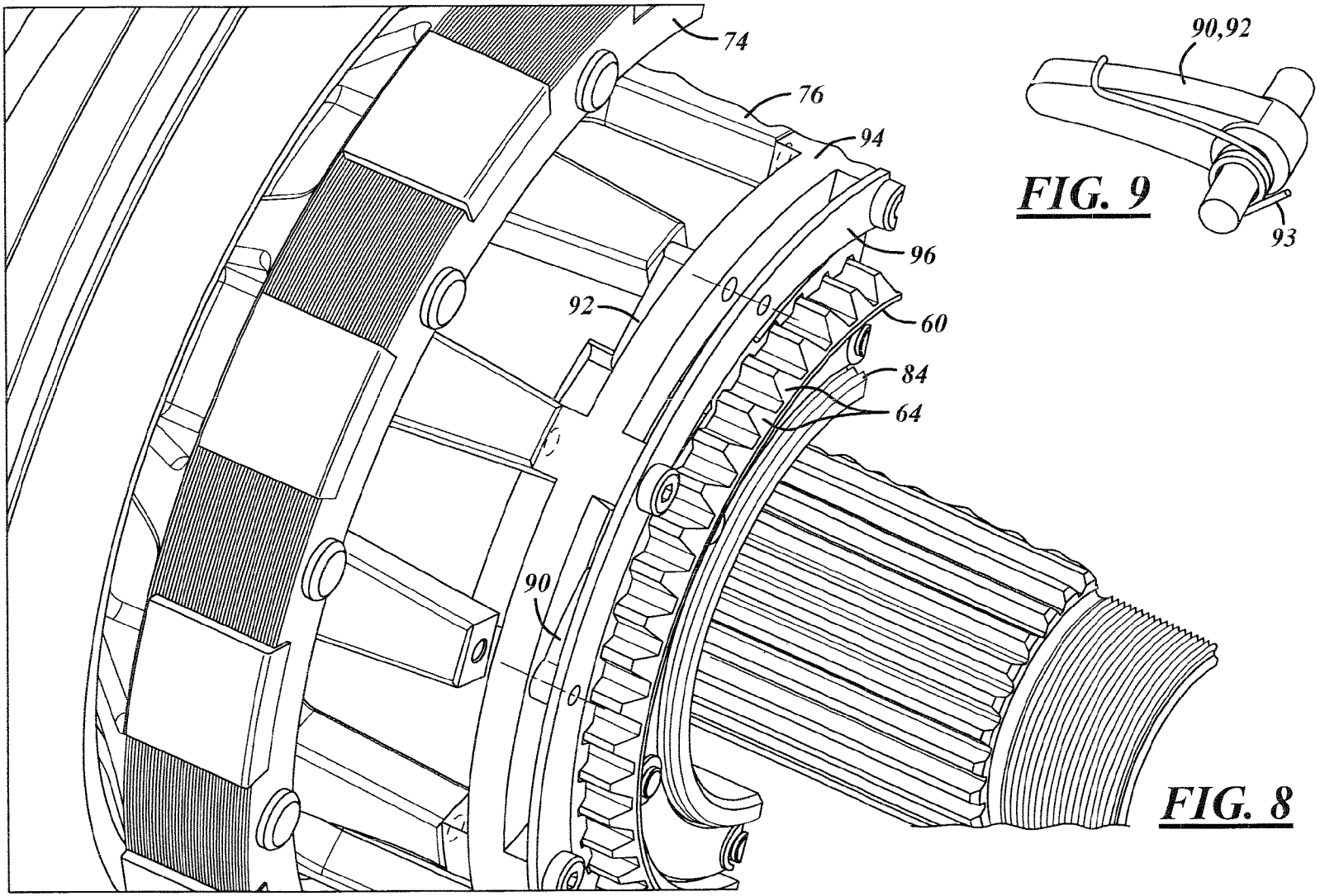
FIG. 8 is another enlarged perspective partial cross-section of a portion of the embodiment shown in FIG. 2.
FIG. 9 illustrates an embodiment of a pawl member which can be used with the present invention.

The motor 30 is a reversible motor and is used to drive the rear sheave 32 to slide in both directions. For the electrical drive mode, a second set of pawl members 92 is provided. As shown in FIG. 8, the pawl members 92 are pivotally attached to pawl spacer member 94. The pawl members are spring biased by spring 93 towards the center shaft member 28.

Representative pawl members 90, 92 are shown in FIG. 9. The pawl members are positioned on opposite sides of the spacer member 94. Both sets of pawl members are spring biased toward the shaft 28.

Figure 7:
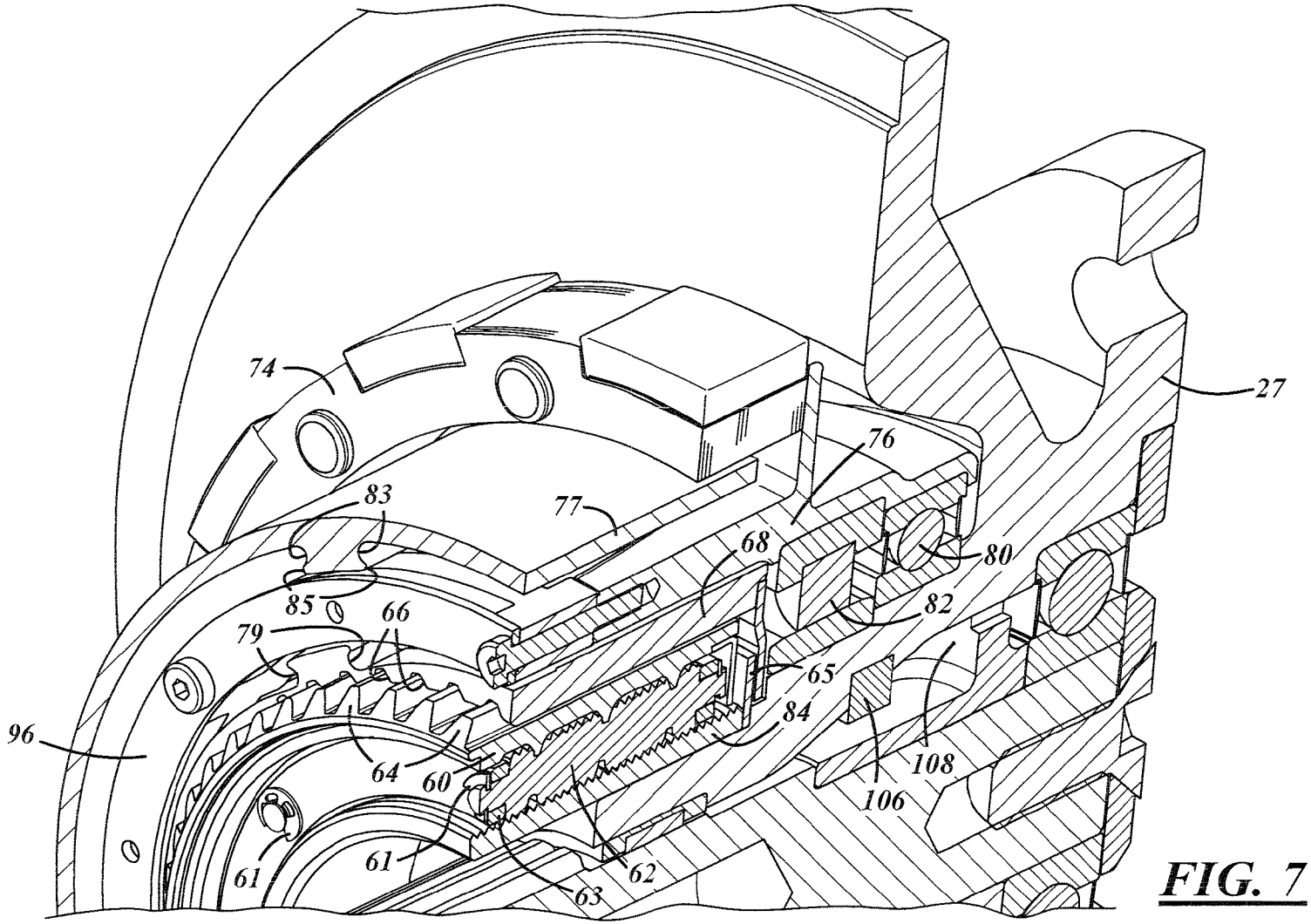
FIG. 7 is an enlarged perspective partial cross-section of a portion of the embodiment shown in FIG. 2.
Figure 13:
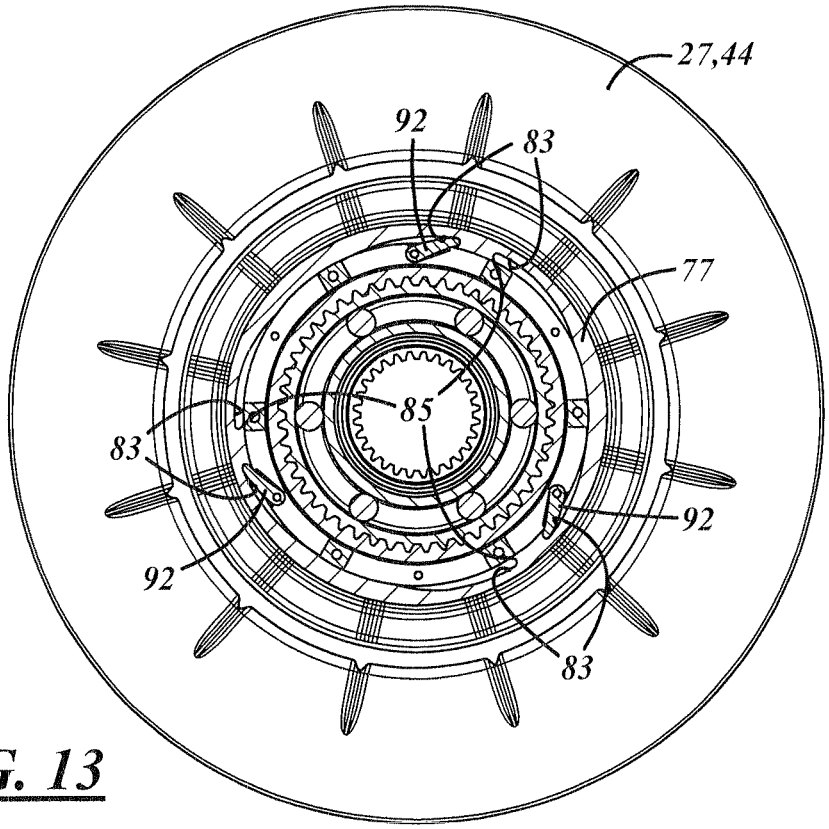

The pawl members 92 are adapted to engage notches 83 in the drive sleeve member 77. (The notches 83 are shown in FIGS. 7 and 13.) The drive sleeve member 77 is connected to the rear sheave member 32, as shown in FIG. 3. By a quick acceleration of the motor 30, the spring biasing of the pawl members 92 is overcome via centrifugal force and the pawl members engage the notches 83. This allows the electric motor 30 to directly drive (rotate) the rear sheave 32. For this purpose, the disengagement mechanism 45 is also activated.

In order to disengage the belt from the two pulley mechanisms, the rear sheave member 32 on the output pulley mechanism is slid axially as far as possible toward the fixed front sheave member 18. This moves the belt 22 as far radially away as possible from the central shaft member 28, which in turn causes the belt 22 to be forced radially inward against the shaft 24 on the input member. When the belt member 22 is located at that position, it is resting on the free spinning surface members 42 and disengaged from the input.

As indicated above, when the belt 22 is disengaged, the hybrid fan drive system is only being run by the electric motor. Due to the pawl-clutch mechanism, the electric motor is directly connected to the rear sheave by the drive sleeve member. Rotation of the rear sheave 32 then causes rotation of the front sheave 18 and rotation of the fan 16.

Also, when the fan is being operated by the electric motor, the speed of the fan is the same as the speed of the motor. When the fan drive is switched or changed back to a mechanical mode, the motor rotation is reversed. This allows the pawls 92 to be disengaged from the drive sleeve member 77 and return to their biased rest position.

As indicated above, pairs of notches 83 are provided around the inner circumference of the drive sleeve member 77. This is best shown in FIG. 13. Preferably, there are three pairs of notches 83 which are spaced circumferentially to mate with the three pawl members 92. Each of the pairs of notches has one notch in each rotational direction. This allows this clutch mechanism to mate the motor with the drive sleeve member in either the forward or reverse directions of the motor 30. Each of the notches also has an overhanging lip 85 which is used to retain the oppositely biased pawls 92 in the notches 83 during rotation.

In order to engage the pawl members 92 in the drive sleeve member 77 and thus operate the fan drive in the electric motor mode, the rotor of the mode is accelerated quickly which flips the pawl members 92 radially outwardly and overcoming the radially inwardly biasing force from the spring members 93. Once the pawl members are caught by the lips 85 in the notches, the pawl members are used to rotate the drive sleeve member 77 and the sheave member 32.

When pawl members 90 are engaged, pawl members 92 are free wheeling. Annular plate member 96 retains the pawl members in position. Preferably there are three pawl members 90 in one clutch mechanism and three pawl members 92 in the other clutch mechanism. However, another number of pawl members and notches could be utilized.

Figure 12:
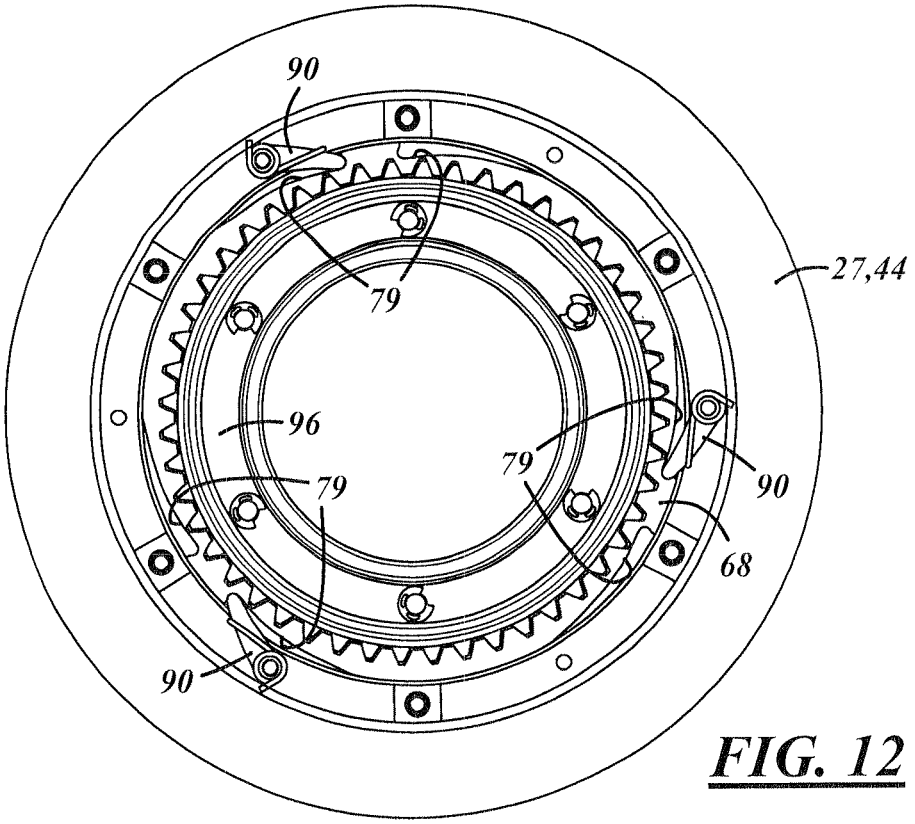
FIGS. 12 and 13 illustrate the pawl-type clutch mechanisms used with an embodiment of the present invention.

Pairs of notches 79 are provided around the outer circumference of the sleeve member 68. This is best shown in FIG. 12. Preferably there are three pairs of notches 79 which are spaced circumferentially to mate with the three pawl members 90. Each of the pairs of notches has one notch in each direction of rotation. This allows this clutch mechanism to connect the sleeve member 68 with the rotor housing 76 regardless of the direction of rotation of the motor 30. Since the pawl members 90 are biased radially inwardly toward the central shaft member 28, the clutch mechanism will automatically engage when the motor rotor is rotating.

The rear sheave member 32 further preferably incorporates front and back guide rings (shown in FIG. 3 but not labeled) which concentrically mate with the spline shaft 28 through a close running fit to minimize sheave wobble.

The motor 30 is electrified by power source 100 which is controlled by the electronic control unit (ECU) 102 of the vehicle (FIG. 3). One or more sensors 104 provide relevant data to the ECU, such as coolant temperature, which are used to control the speed of the cooling fan.

The speed of the fan is measured using a gear sensing Hall Effect Device (HED) 106. This is shown in FIGS. 3 and 7. The HED is positioned in the housing 27 and is adopted to read and secure measurements from gear 108. The gear 108 is attached to the rotating control shaft member 28.

One or more flyweights 50 are attached to the input member and provide a tensioning system for the CVT system. This is shown in FIGS. 2 and 4. The flyweight system is designed so that when the ratio increases, the weights move out further from the center of rotation of the input member. The flyweights 50 are pivotally attached at one end 46 to a portion of the shaft 24, and connected adjacent the other end by a spring biasing member 48 to the rear sheave 49. The front sheave member 33 is stationary. With this system, the flyweight system can be optimized to match the desired belt tension map. It is believed that the belt tension needed to prevent slip under most operating conditions with the present invention will be less than 10% of that required at the highest drive ratio and input speed. Thus, the tensioning mechanism is expected to improve belt life.

Figure 10:
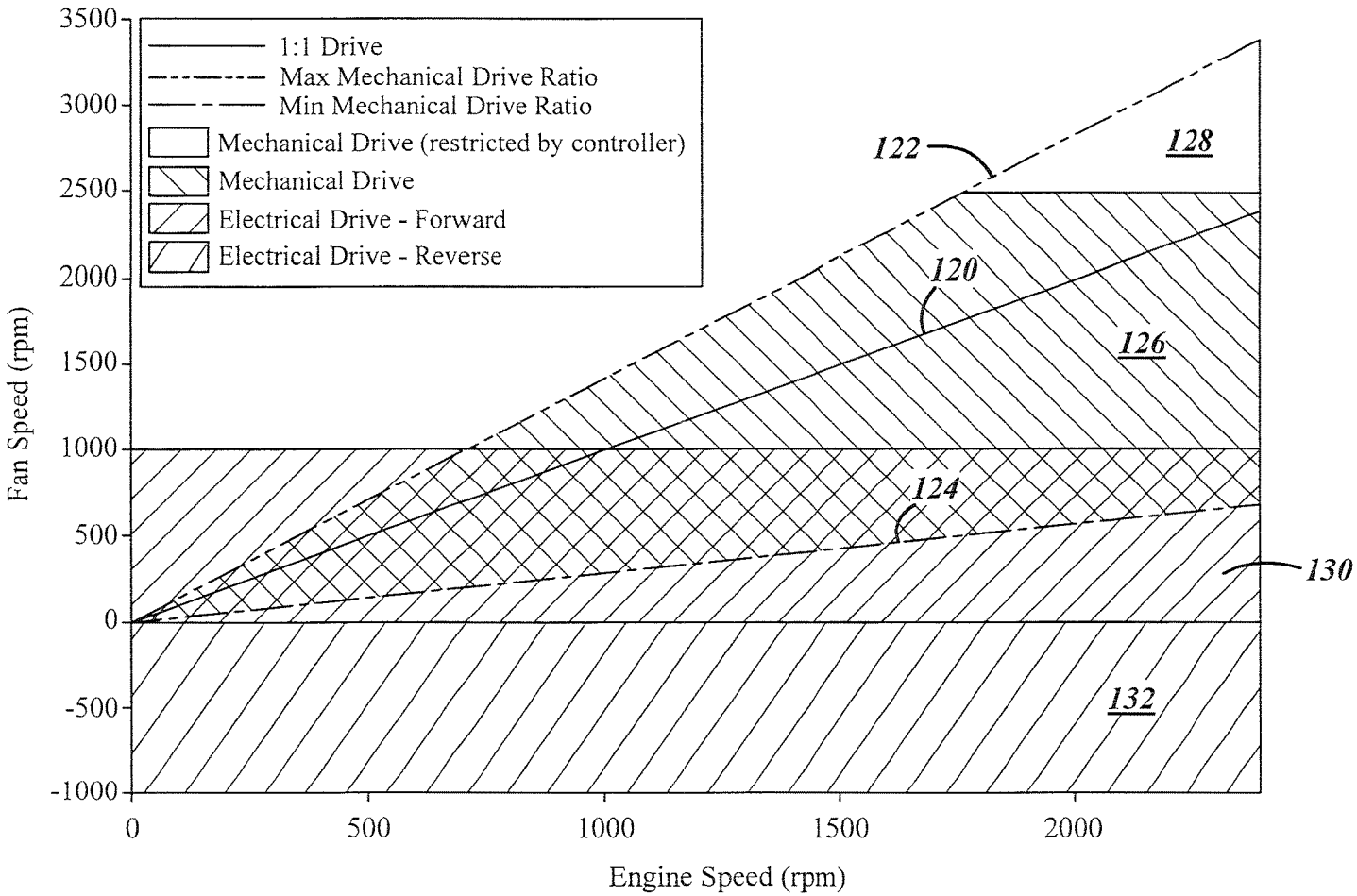
FIG. 10 is a graph that illustrates the functional modes of a hybrid fan drive in accordance with the present invention.

The functional modes of the hybrid fan drive in accordance with the invention is shown in graph form in FIG. 10. The direct 1:1 drive curve is identified as 120. The maximum mechanical drive ratio is shown by curve 122 and the minimum mechanical drive ratio is shown by curve 124. The basic mechanical drive is shown by shaded area 126. The mechanical drive (restricted by controller) is shown by area 128.

The electric drive in the forward direction is shown by shaded area 130, while the electric drive in the reverse direction is shown by shaded area 132.

Figure 11:
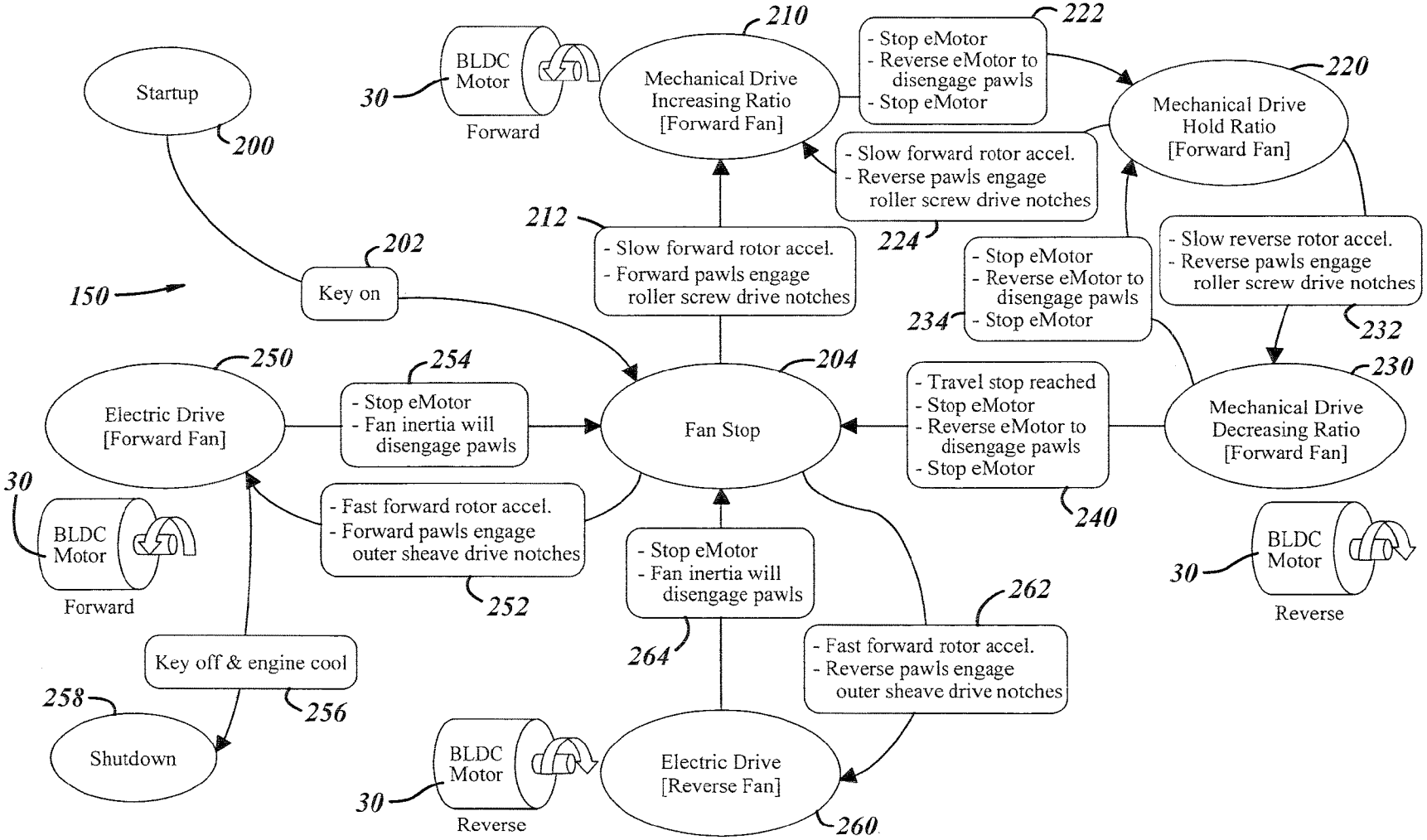
FIG. 11 is a state transition diagram depicting the drive mode transition process in accordance with the present invention.

The mode transition process for the hybrid fan drive is shown in FIG. 11 and referred to generally by reference numeral 150. All of the various modes of the hybrid fan drive for both mechanical drive and electric motor drive (both forward and reverse) are depicted. An explanation of the functioning and operation of a hybrid fan embodiment as set forth in FIG. 11 is set forth as follows.

At start up 200 of the vehicle when the key is inserted and turned on 202, the cooling fan is not operating 204. For the mechanical drive mode where the fan is increasing in speed 210, the motor rotor 74 accelerates slowly and the forward pawls 90 engage notches 79 in the sleeve member 68. This is shown in Box 212. The motor 30 is turning in the forward direction.

When the fan has reached the appropriate cooling speed, the mechanical drive is in the "hold ratio" position 220. In order to reach that position, the motor 30 is stopped, the motor is quickly reversed to disengage the pawls 90 and then stopped. This is shown in Box 222. If it is desired to increase the speed of the fan from the "hold ratio" position, the motor is accelerated slowly in the forward direction and the reverse pawls engage the roller screw drive notches. This is shown in Box 224.

When it is required to decrease the speed of the fan, the mechanical drive is in the "decreasing ratio" position 230. The motor rotor is slowly accelerated in the reverse direction and the reverse pawls engage the roller screw drive notches. This is shown in Box 232.

When it is desired to return the speed of the fan to its hold ratio position 220, the motor is stopped and then reversed to disengage the pawls. The motor is then stopped again. This is shown in Box 234. When the vehicle reaches its destination and the engine is turned off, the motor is stopped and then reversed to disengage the pawls. The motor is subsequently stopped and so is the fan 204. This is shown in Box 240.

In order to activate the electric drive mode 250, the motor is driven fast in the forward direction which accelerates the rotor. This engages the pawls 92 with the notches 83 on the drive sleeve member 77. This is shown in Box 252. If the rotation of the fan needs to be stopped, then the motor 30 is stopped. The inertia of the rotating components will disengage the pawls from the drive sleeve member 77. This is shown in Box 254. If the operator wants to turn off the vehicle, the key is turned to its off position. This is shown in Boxes 256 and 258. The engine will cool down over time.

It is also possible to drive the motor in the reverse direction. This is shown in Box 260. In order to achieve this from a fan stop position, the rotor of the motor is accelerated quickly. This engages the reverse pawls in the drive sleeve member 77. This is shown in Box 262. When it is desired to stop the rotation of the fan, the motor is stopped. The inertia of the fan will disengage the pawls. This is shown in Box 264.

Although the invention has been described with respect to preferred embodiments, it is to be also understood that it is not to be so limited since changes and modifications can be made therein which are within the full scope of this invention as detailed by the following claims.

What is claimed is:

1. A hybrid system for driving a cooling fan comprising:

a driving member having a pair of sheave members and a first rotating shaft member, said shaft member connected to a source of rotary motion;

a driven member having a pair of sheave members and a second rotating shaft member, a first sheave of said pair of sheave members of said driven member being securely attached to said second rotating shaft member, and second sheave of said pair of sheave members of said driven member being slidingly connected to said second rotating shaft member;

a belt member connected between said driving member and said driven member;

a fan member attached to said first sheave of said pair of sheave members of said driven member on said driven member;

a sheave actuation system for axially sliding said second sheave of said pair of sheave members of said driven member on said driven member along said second rotating shaft member;

said sheave actuation system comprising an electric motor and a planetary roller screw mechanism; and a clutch mechanism for allowing said electric motor to independently drive said driven member.

2. A hybrid system as described in claim 1 wherein said driving member has at least one flyweight to provide tensioning to the belt drive system.

3. The hybrid system as described in claim 1 further comprising a belt disengagement mechanism on said driving member.

4. The hybrid system as described in claim 3 wherein said belt disengagement mechanism comprises a pair of free spinning surface members.

5. The hybrid system as described in claim 4 further comprising bearing members for allowing rotation of said pair of free spinning surface members independent of said driving member.

6. The hybrid system as described in claim 1 wherein said belt member is a V-shaped belt member.

7. The hybrid system as described in claim 1 further comprising a Hall Effect Device for measuring the speed of rotation of said second rotating shaft member.

8. The hybrid system as described in claim 7 wherein said Hall Effect Device also measures the speed of said fan member.

9. The hybrid system as described in claim 1 wherein said electric motor is a brushless DC motor.

10. The hybrid system as described in claim 1 further comprising a sheave drive member attached to said second of said pair of sheave members on said driven member, and said clutch mechanism selective connecting said sheave drive member directly to said electric motor.

11. The hybrid system as described in claim 10 wherein said clutch mechanism is a pawl-type clutch mechanism.

12. The hybrid system as described in claim 1 wherein said clutch mechanism is a pawl-type clutch mechanism.

13. The hybrid system as described in claim 1 wherein said electric motor comprises a stator member and a rotor member, and further comprising a rotor housing member attached to said rotor member and rotatable therewith.

14. The hybrid system as described in claim 13 further comprising a sheave drive member attached to said second of said pair of sheave members on said driven member, and said clutch mechanism is a pawl-type clutch mechanism with a plurality of pawl members, said sheave drive member having a plurality of notches for mating with said pawl members.

15. The hybrid system as described in claim 1 wherein said planetary roller screw mechanism comprises a roller screw housing member, a threaded sleeve member and a plurality of roller members.

16. The hybrid system as described in claim 15 wherein said threaded sleeve member has spiral-type screw threads and said roller members have circular-type ridge members.

17. The hybrid system as described in claim 1 further comprising a thrust bearing positioned between said planetary roller screw mechanism and said second sheave of said pair of sheave members of said driven member.

18. The hybrid system as described in claim 1 wherein said electric motor has a stator member, a rotor member, and a rotor housing member, and further comprising a second clutch mechanism for selectively engaging said rotor housing member to said planetary roller screw mechanism.

19. A hybrid system for driving an accessory member for a vehicle engine, said system comprising:

a driving member having a pair of sheave members and a first rotating shaft member, said shaft member connected to a source of rotary motion;

a driven member having a pair of sheave members and a second rotating shaft member, a first sheave of said pair of sheave members of said driven member being securely attached to said second rotating shaft member, and a second sheave of said pair of sheave members of said driven member being slidingly connected to said second rotating shaft member;

a belt member connected between said driving member and said driven member;

an accessory member attached to said first sheave of said pair of sheave members of said driven member on said driven member;

a sheave actuation system for axially sliding said second sheave of said pair of sheave members of said driven member on said driven member along said second rotating shaft member;

said sheave actuation system comprising an electric motor and a planetary roller screw mechanism; and a clutch mechanism for allowing said electric motor to independently drive said driven member.

20. The hybrid system as described in claim 19 wherein said accessory member comprises a fan member.

* * * * *